United States Patent [19]

Krebel et al.

[11] 4,223,505

[45] Sep. 23, 1980

[54] INSULATING PANEL FASTENING SYSTEM

[75] Inventors: Edgar A. Krebel; Walter Z. Vaden; Robert H. Blanpied, all of Dallas, Tex.

[73] Assignee: Rmax, Inc., Dallas, Tex.

[21] Appl. No.: 942,825

[22] Filed: Sep. 15, 1978

[51] Int. Cl.[2] ..... E04B 1/38

[52] U.S. Cl. ..... 52/509; 52/489; 52/714

[58] Field of Search ..... 52/509, 714, 715, 281, 52/481, 480, 738, 765, 404, 489

[56] References Cited

U.S. PATENT DOCUMENTS

| | | | |
|---|---|---|---|
| 3,405,493 | 10/1968 | Omholt | 52/480 |
| 3,553,919 | 1/1971 | Omholt | 52/480 X |
| 3,619,963 | 11/1971 | Omholt | 52/480 X |
| 4,052,831 | 10/1977 | Roberts et al. | 52/309.8 |
| 4,112,636 | 9/1978 | Hays | 52/489 |

*Primary Examiner*—Price C. Faw Jr.
*Assistant Examiner*—Carl D. Friedman
*Attorney, Agent, or Firm*—Hubbard, Thurman, Turner, Tucker & Glaser

[57] ABSTRACT

Apparatus for fastening building construction insulating panels to a supporting wall structure comprising a slotted channel member and an anchoring clip. The channel has flanges by which it is secured to a supporting wall structure and a slotted mounting surface spaced from the supporting wall a preselected distance to provide improved insulation. The anchoring clip has opposed flanges on one end for engaging the edges of adjacent insulating wall panels and an anchor on the opposite end for engaging the slot in the channel and thereby holding the insulated panel to the supporting wall with the preselected spacing.

8 Claims, 6 Drawing Figures

INSULATING PANEL FASTENING SYSTEM

BACKGROUND OF THE INVENTION

This invention relates to building construction of the type where insulating panels are attached to supporting walls, ceilings or roofs, and in particular to apparatus for attaching insulating panels to a supporting surface.

A reference believed to be relevant to the present invention in U.S. Pat. No. 4,052,831 issued to Roberts et al on Oct. 11, 1977. The Roberts et al patent teaches in particular a special clip for securing insulating composite wall panels to supporting walls. As taught by the patent the use of a composite panel having a layer of foamed plastic insulating material covered by a hard rigid layer of, for example, gypsum wall board over a masonry structural wall has several distinct advantages. Such panels provide both insulation and an interior dry wall surface in a single installation step while consuming less volume than other finishing methods. The Roberts patent teaches a particular clip for retaining the panels with the intent of facilitating the installation, improving the finished appearance, and improving the insulation qualities of the finished panels. The clip comprises a sheet metal web having flanges on one edge for engaging adjacent insulation panels and a flange on the other edge for nailing or otherwise securing to the supporting wall structure.

The Roberts clip provides alignment of adjacent panels by requiring that the panel-anchoring flanges penetrate the foamed plastic layer exactly at its interface with the rigid board facing. This arrangement has several disadvantages. A hard, rigid board must be bonded to a soft insulation layer, such as foam plastic, while leaving a clearly marked interface. A variety of clips must be provided, each having a web width corresponding to the various foam layer thicknesses produced. Alignment is dependent upon the panel-anchoring flanges remaining parallel to the supporting wall and in precisely the same plane. Any warping of the flanges prevents perfect alignment of the panels. The Roberts clip also provides spacer projections on the securement flange, primarily to provide a small (0.1 inch) air space behind the panels. The spacer projections are also supposed to prevent distortion of the web and panel-anchoring flanges. But, since the clip is a one piece structure, some distortion of the flanges' position and alignment does occur when power driven nails are used. While proper spacing of the second installed of adjacent wall panels should be insured by a guide ramp and the securement flange, like spacing of the first installed panel is solely dependent upon proper insertion of the panel anchoring flange at the foam/facing interface. Securement flange distortion can cause misalignment or non-penetration due to the panel securing flange meeting the hard rigid board.

As taught in the Roberts patent and as otherwise known it is desirable to have an appreciable air space between the insulation panels and the supporting wall to prevent moisture accumulation and the growth of mold, etc. This type of wall panels are covered with a layer of aluminum foil to prevent the loss of fluorochlorocarbons and the diffusion of moisture vapor into the foam plastic insulation to help maintain exceptionally good "R" values. The aluminum foil also adds a substantial amount of insulation on its own if it is spaced from the supporting wall structure by an optimum air space of about three quarter of an inch.

SUMMARY OF THE INVENTION

Accordingly, an object of the present invention is to provide an improved means for attaching insulating panels to a supporting structure.

Another object of the present invention is to provide means for positively aligning the edges of both composite and non-composite insulating panels while uniformly spacing such panels from a supporting structure.

According to the present invention, insulating panels are attached to a supporting ceiling, roof or wall structure by a two part assembly comprising a channel member and an anchoring clip. The channel member has a substantially flat panel mounting surface with a narrow slot in it, sidewalls for spacing the mounting surface from a supporting wall, and flanges on the sidewalls for securing the channel member to the supporting structure and for increasing the stability of the channel member. The anchoring clip has opposing flanges on one edge of the web for engaging the edges of adjacent insulation panels and an anchor on the opposite end for engaging the slot and holding the entire assembly, including the panel, to the channel member, and thereby to the supporting structure.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
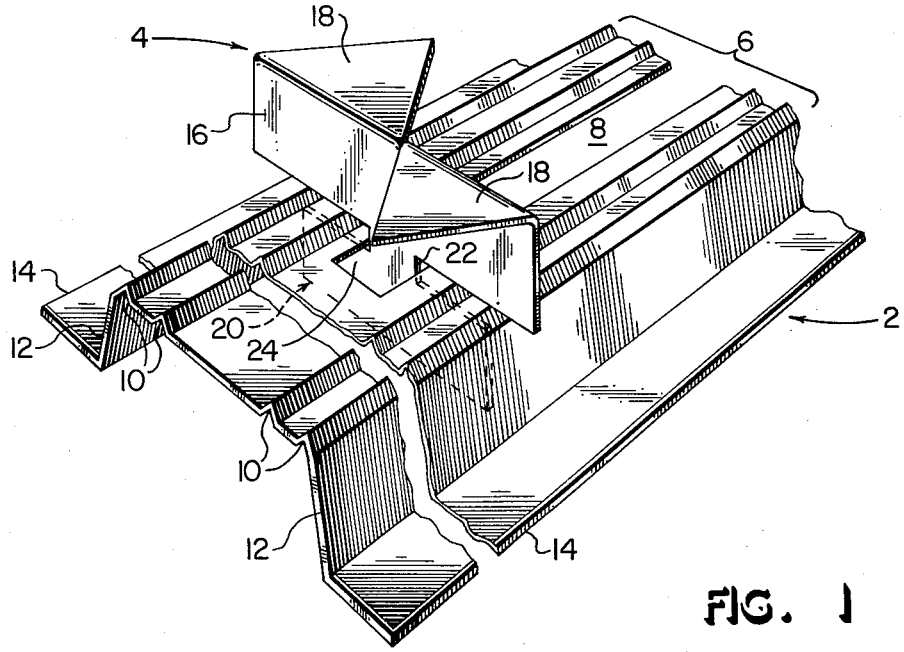
FIG. 1 is a perspective view of a channel member and a first version of an anchoring clip according to the present invention.

The concept of the present invention is best illustrated by reference to the perspective view of FIG. 1 illustrating the combination of a channel member 2 with a clip member 4. Channel member 2 has an essentially flat panel mounting surface 6 in which is formed an elongated anchoring slot 8. In the preferred form the surface 6 has four parallel ridges 10 which strengthen the surface 6 mechanically. The channel 2 has a pair of sidewalls 12 extending from the edges of the mounting surface 6 at slightly more than 90 degrees (see FIG. 2). Each of the sidewalls 12 has a flange 14 extending at slightly more than 90 degrees from the sidewalls 12 so that flanges 14 are essentially parallel to the mounting surface 6. As is apparent, the channel member 2 is conveniently made from a single strip of sheet metal which in a preferred form is 24 gauge galvanized steel. The flanges 14 provide a convenient area for securing the channel to a supporting wall structure. The sidewalls 12 serve several functions, the primary one being to provide an optimum and uniform air space between insulating panels mounted on surface 6 and a supporting wall structure. In a preferred form the channel 2 is thirty-two inches long and the slot 8 is eight inches long and centered in the channel 2. Also in the preferred form the width of slot 8 is slightly over one-half inch and the width of the panel mounting surface 6, and therefore the space between sidewalls 12 is approximately two inches. As illustrated in FIG. 1 is a first form of a panel anchoring clip 4. This clip has a central web portion 16 and insulation panel engaging flanges 18 very similar to those in the above-referenced U.S. Pat. No. 4,052,831. But, contrary to the teaching of that patent, a single web width of about three-quarters of an inch is preferred. This width corresponds to the minimum foam layer thickness normally used. For panels with thicker insulation layers, the flanges 18 penetrate the foam at a point other than the foam/rigid board interface. This arrangement provides some foam insulation between the flanges 18 and the building interior (for foam layers thicker than three-quarter inch), thus reducing "thermal short" heat loss. The three-quarter inch layer has sufficient strength to hold the panels in place.

A portion of clip 4 forms an anchor 20 for attaching the clip to the channel 2. A simple form of anchor is illustrated in FIG. 1 mostly in dotted line form since it is illustrated anchored within the channel 2. In this simplified form the anchor comprises basically a portion 22 of web 16 which is more narrow than the width of slot 8 and a second portion 24 of web 16 which is wider than slot 8. Both portions 22 and 24 are in the same plane as the rest of web 16. Thus as illustrated in FIG. 1 the anchor comprises a T-shaped portion of web 16 which is easily inserted into slot 8 when the clip 4 is rotated 90 degrees from the position shown in FIG. 1 but which anchors the clip 4 to the channel 2 when rotated to position illustrated in FIG. 1.

Figure 2:
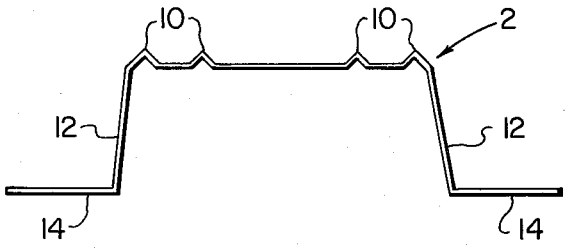
FIG. 2 is a cross section of the channel of FIG. 1.

FIG. 2 illustrates a cross section of the channel 2 of FIG. 1. The same designation numbers are used to identify like portions of the channel.

Figure 3:
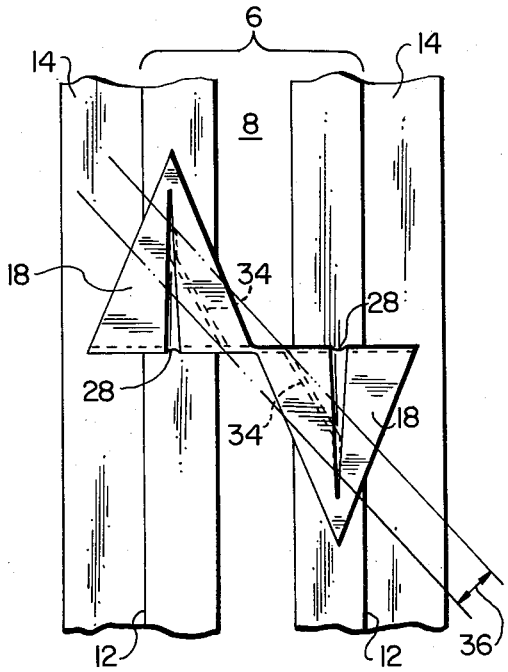
FIG. 3 is a view of a preferred anchoring clip according to the present invention.
Figure 4:
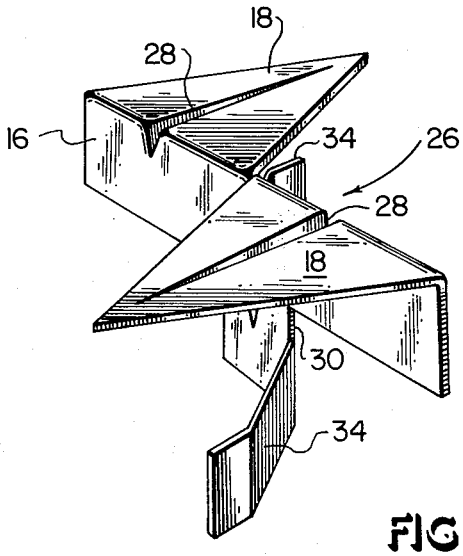
FIG. 4 is a perspective view of the anchoring clip shown in FIG. 3.

With reference now to FIGS. 3 and 4 there is illustrated in plan and perspective views, respectively, a preferred panel retaining clip according to the present invention. This preferred clip illustrated generally at 26 has a web portion 16 and prongs 18 essentially identical to those of clip 4. As illustrated, reinforcing crimps 28 are provided in a conventional manner to strengthen the junction between the web 16 and the prongs 18. A narrow extension portion 30 from web 16 has a width of slightly under half an inch so that it will fit into the slot 8 in channel 2 in the same manner as clip 4 is shown in FIG. 1. An anchor portion 32 of clip 26 provides an improved anchoring function as compared to the simple flat anchor arrangement illustrated in FIG. 1. The anchor portion 32 is also generally a T-shaped element but the arms 34 of the T are not in the same plane as web 16 and extension 30. As illustrated most clearly in FIG. 3 the arms 34 are bent along lines which are perpendicular to the plane of prongs 18 so that each of the pair of arms extends out to match one of the prongs 18. The particular angle and form of the arms 34 is selected so that the dimension 36 illustrated in FIG. 3 is less than the width of slot 8 illustrated in FIG. 1. In this way the clip anchor 32 may be inserted into the panel slot easily and then rotated to an anchoring position.

It can be seen that the anchoring clip 26 has a distinct advantage over the clip 4. In particular the simple T-shaped anchor used on clip 4 allows some tilting of the clip 4 so that the flanges 18 may not remain parallel to the mounting surface 6. The clip 26 provides a two dimensional contact between the anchor arms 34 and the bottom side of mounting surface 6 which aids in maintaining prongs 18 parallel with the mounting surface 6. It is apparent that a number of different shapes of arms 34 would provide the two dimensional contact and would still fit within the half inch channel slot for installation purposes. The arms 34 may in fact be bent in opposition to the flanges 18 and still provide the improved stability. The illustrated arrangement is preferred primarily because it is easier to manufacture.

The apparatus of the present invention is used for the same purposes as the clip structure of U.S. Pat. No. 4,052,831 but has several distinct advantages in use. As noted in that patent, there is a concern for the possibility of deforming the mounting clip when the securement flange is secured to supporting wall by means of a power tool. Any such deformation obviously can change the dimensions, shape, position, and direction of the clip and affect its ability to properly anchor a wall panel. The two piece assembly of the present invention provides a large pair of flanges 14 which extend over a considerable portion of a supporting wall surface to allow the securing screws or nails to be placed at convenient points. The flanges 14 are spaced approximatley three-quarter inches (width) from the panel mounting surface 6 and due to the size, strength, and natural rigidity of the channel structure the inevitable deformation of the flanges 14 will not materially affect the mounting surface 6. Since the anchoring clip 4 (or 26) is a separate part inserted into the channel 2 after the channel is attached to a supporting wall, there is no chance for any deformation or distortion of the shape of the securing clip 4 (or 26). With the dimensions which have been previously given for channel 2 there is considerable leeway in the positioning of the channel so that precise and time consuming alignment of the channel is not required. The fairly large mounting area 6 provides an effective surface for assuring proper alignment of adjacent wall panels in spite of distortion of flanges 14. Both edges of adjacent wall panels will always contact the same mounting surface 6 on the side facing the supporting wall structure. Proper alignment is not dependent upon insertion of panel-anchoring flanges at any particular point, such as the foam/rigid board facing interface, in the panels. As a result the present invention is not limited to wall panel assemblies in which the panels include a rigid board facing. The assembly may include any panel comprising at least one layer of relatively soft material including such things as glass fiber mats as well as the foamed plastic materials discussed specifically herein.

Figure 6:
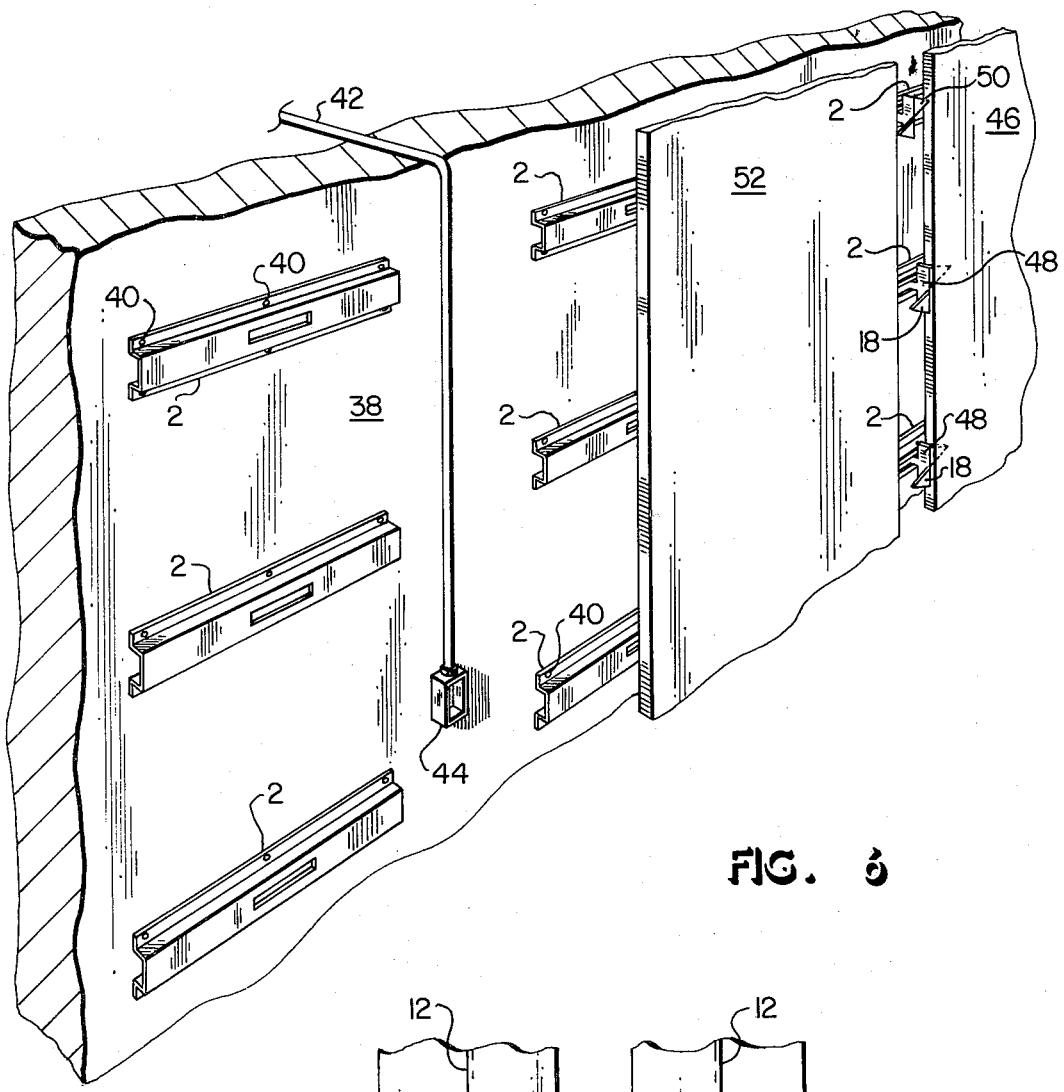
FIG. 6 is an illustration of building construction according to the present invention.

With reference to FIG. 6 the general method of wall construction according to the present invention is illustrated. The first step is the installation of a number of channel members 2 on a supporting wall surface 38. It is preferred to use three rows of channels 2 with horizontal spacing corresponding to panel widths. The channels are typically attached by powder driven nails 40 driven through flanges 14 of the channels. This step can be performed by a single workman, if desired, so that the smallest number of workmen are exposed to the high noise levels generated by powder nail drivers or other power driving equipment. After the channels 2 are installed electrical conduit 42 and connector boxes 44 may be positioned between the channels 2 and attached to wall surface 38.

After channels 2 are installed and rough wiring is complete, wall panels may be quickly installed. The left side of a panel 46 is shown in place against channels 2 with a pair of anchoring clips 48 engaging the edge of the panel and holding it against the channel member. A third anchoring clip 50 is shown in position in slot 8 of a channel 2 ready for driving into the edge of panel 46 as it is held against the channel member. When all three clips 48, 50 are firmly driven into the edge of panel 46 a second panel 52 may be installed. Panel 52 is positioned flat against the channel members 2 a short distance from panel 46 as illustrated. The first edge of panel 52 is then permanently anchored by sliding panel 52 to the right whereupon the exposed flanges 18 of clips 48, 50 engage the right edge of panel 52. The second edge of panel 52 is anchored with three more anchoring clips in the same manner as described above for panel 46. A third panel will then be installed to the left of panel 52 in similar fashion. This third panel should, of course, have a hole cut in it to provide access to electrical connection box 44.

It thus can be seen that the panel members themselves may be installed rapidly once the channel members are attached to the supporting wall structure and that the resulting panel assembly provides a substantial air space between the insulating panels and the supporting wall structure which increases the total insulation value considerably more than the nominal 0.1 inch taught by the above referenced patent. This space also provides a convenient area for running electrical wiring and avoids the need for cutting into the insulation panel itself for such purposes which would reduce the insulation value.

A contemplated improvement to clips 4 or 26 would be a pair of short arms extending at right angles from the edges of narrow extensions 22 or 30 of webs 16. These arms would be formed from material otherwise cut out in the manufacturing process. These arms would ride along the inside edges of the channel slot 8 providing substantial rotational stability. The greatest stability would be achieved by having the short arms extend in the same direction, but a cutout would have to be made in surface 6 for insertion of such a clip into slot 8. Since such a cutout would reduce the strength and rigidity of surface 6 and use of the short arms in opposition to each other would prevent rotation in only one direction, such arms are not used in the preferred embodiment.

Figure 5:
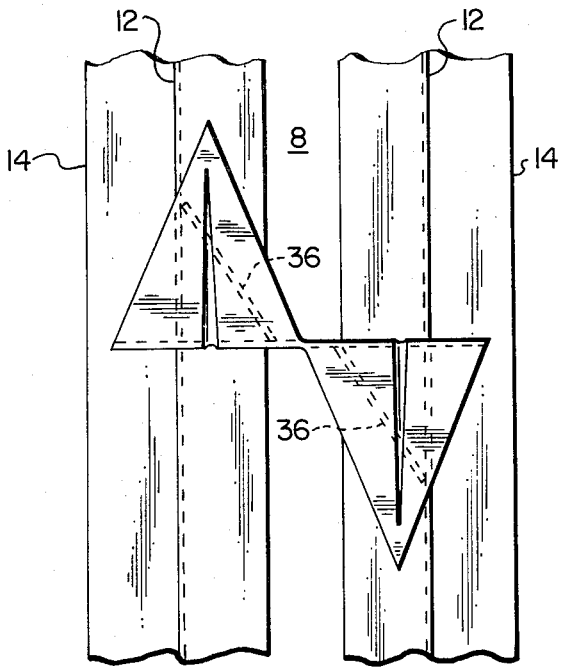
FIG. 5 is an illustration of another anchoring clip according to the present invention.

Yet another contemplated form of the panel anchoring clip is illustrated in FIG. 5. This embodiment differs from that shown in FIG. 3 only in the particular shape of the arms of the T-shaped anchor. Arms 36 are bent so that the extreme ends abut the inside surfaces of the side walls 12 of the channel member 2. In this way both resistance to tilting and to rotation (in one direction) are achieved with a single pair of anchoring arms 36.

To reduce the possibility of panel vibration it may be desirable to use a construction adhesive in addition to the mounting clip system described herein. The portions of the channel member 2 extending on either side of the slot 8 provide a convenient area for application for such construction adhesive at the time the panels are placed against the channels.

While the present invention has been illustrated in terms of specific apparatus, it is apparent that other modifications and changes can be made within the scope of the present invention as defined in the appended claims.

We claim:

1. Panel building construction comprising:

a supporting structure in the nature of a wall, ceiling or roof structure having a substantially flat panel-receiving face;

substantially flat rectangular building insulating panels comprising at least one layer of a relatively soft insulating material having a preselected minimum thickness; and panel fastening apparatus for securing said panels to said panel-receiving face, said apparatus including: channel members each having a substantially flat rectangular panel mounting surface having an elongated slot therein, side walls extending approximately perpendicularly from said panel mounting surface, and securement flanges extending approximately perpendicularly from said side walls, said securement flanges positioned against said panel-receiving face, said channel members having lengths less than the width of said panels, and said side walls having lengths selected to space said panel mounting surfaces from said supporting structure by a preselected distance; means rigidly attaching said securement flanges to said panel-receiving face; and, an anchoring clip having a rectangular web having a width no greater than said minimum thickness, a pair of panel securing flanges extending substantially perpendicularly and in mutually opposite directions from a first edge of said web, and a channel anchor extending from a second edge of said web, said channel anchor positioned within and anchored to said slot in said panel mounting surface, said panel securing flanges having pointed edges penetrating edges of the layer of insulating material of a pair of adjacent panels and thereby holding said pair of adjacent panels in contact with said panel mounting surface.

2. Apparatus for mechanically securing building construction panels, edge-face to edge-face, to a supporting structure in the nature of a wall, ceiling, or roof structure having a panel-receiving face comprising a substantially flat surface, said panels each having at least one layer of a relatively soft insulating material, said apparatus including a channel member formed from a single strip of sheet metal having a substantially flat panel mounting surface, side walls extending approximately perpendicularly from said mounting surface, and securement flanges adapted to be secured to said receiving face of the supporting structure extending approximately perpendicularly from said side walls, said panel mounting surface further having a slot for receiving a clip, and a clip formed from a single strip of sheet metal having a flat web strip and a pair of flanges extending substantially perpendicularly from a first edge of the web strip, said pair of flanges extending in mutually opposite directions, and a channel anchor attached to a second edge of the web strip opposite said first edge for securing said clip to said channel by insertion into said slot, said channel anchor comprising an extenstion of said web having a width less than the width of the slot in said channel, and a pair of arms extending in mutually opposite directions from said extension at an angle of 90 degrees or more, said arms having planar surfaces perpendicular to the surfaces of said pair of flanges.

3. Apparatus according to claim 2 wherein said arms extend from said extension on sides corresponding to said pair of flanges.

4. Apparatus according to claim 2 wherein said panel mounting surface has a plurality of shallow ridges extending the length of said channel member parallel to said slot.

5. Panel fastening apparatus for securing flat panels having at least one layer of a relatively soft insulating material to a substantially flat supporting structure comprising a channel member having a substantially flat rectangular panel mounting surface having an elongated slot herein, side walls extending approximately perpendicularly from the opposite longer edges of said panel mounting surface, and securement flanges extending approximately perpendicularly from said side walls, said securement flanges lying in a plane and adapted to be secured to said supporting structure, and an anchoring clip having a rectangular web, a pair of panel securing flanges extending substantially perpendicularly and in mutually opposite directions from a first edge of said web, said flanges adapted for penetrating an edge of a wall panel within said relatively soft insulating layer, and a channel anchor attached to a second edge of said web opposite said first edge, adapted for insertion into said slot for securing said clip to said channel, said channel anchor comprising a T-shaped extension of said web with the arms of said T-shaped extension bent out of the plane of said web and the surfaces of said arms perpendicular to the plane of said panel securing flanges.

6. Panel fastening apparatus according to claim 5 wherein said arms of said T-shaped extension are bent in directions corresponding to said panel securing flanges.

7. Panel fastening apparatus for securing flat panels having at least one layer of a relatively soft insulating layer having a minimum preselected thickness, to substantially flat supporting structure comprising:

a channel member having a substantially flat rectangular panel mounting surface having an elongated slot along a portion of its length, side walls extending approximately perpendicularly from the opposite longer edges of said panel mounting surface, and securement flanges extending approximately perpendicularly from said side walls, said securement flanges lying in a plane and adapted to be secured to said supporting structure, and said side walls having a width selected to space said panel mounting surface from said supporting structure by a preselected distance, and an anchoring clip having a rectangular web having a width no greater than said minimum preselected thickness, a pair of panel securing flanges extending substantially perpendicularly and in mutually opposite directions from a first edge of said web, said flanges having pointed edges opposite said web adapted for penetrating an edge of a wall panel within said relatively soft insulating layer, and a channel anchor attached to a second edge of said web opposite said first edge, adapted for insertion into said slot for securing said clip to said channel.

8. In panel building construction of the type in which substantially flat building insulating panels each comprising at least one layer of a relatively soft insulating material are held in edge to edge relationship against a supporting structure having a substantially flat panel receiving face, the improvement comprising:

the use of channel members each having; a substantially flat rectangular panel mounting surface having an elongated slot therein, sidewalls extending approximately perpendicularly from said panel mounting surface, and securement flanges extending approximately perpendicularly from said side walls and adapted for attachment to said panel-receiving face, for supporting panels in spaced relation from said panel-receiving face and providing a substantial surface for adhesively fastening said panels to said channels and thereby to said panel-receiving face; and the use of anchoring clips each having a rectangular web, a pair of panel securing flanges extending substantially perpendicularly and in mutually opposite directions from a first edge of said web, and a channel anchor extending from a second edge of said web and adapted for engaging said channel slot for mechanically fastening said panels to said panel-receiving face by engagement of said channel anchors with slots in said channels and engagement of said panel-receiving flanges with edges of the layer of insulating material of pairs of adjacent panels.

* * * * *

UNITED STATES PATENT AND TRADEMARK OFFICE

CERTIFICATE OF CORRECTION

PATENT NO. : 4,223,505

DATED : September 23, 1980

INVENTOR(S) : Edgar A. Krebel; Walter Z. Vaden; and Robert H. Blanpied

It is certified that error appears in the above—identified patent and that said Letters Patent is hereby corrected as shown below:

Column 3, line 7, "as" should be --Also--.

Signed and Sealed this

*First* Day of *December 1981*

[SEAL]

*Attest:*

GERALD J. MOSSINGHOFF

*Attesting Officer*

*Commissioner of Patents and Trademarks*